US005341864A

United States Patent [19]

Rupel et al.

[11] Patent Number: 5,341,864

[45] Date of Patent: Aug. 30, 1994

[54] ADJUSTABLE EXPANDABLE AND COLLAPSIBLE SHADE

[75] Inventors: John D. Rupel, Verona; Paul F. Josephson, Madison, both of Wis.

[73] Assignee: Springs Window Fashions Division, Inc., Middleton, Wis.

[21] Appl. No.: 53,085

[22] Filed: Apr. 26, 1993

Related U.S. Application Data

[63] Continuation-in-part of Ser. No. 951,151, Sep. 25, 1992, Pat. No. 5,207,257.

[51] Int. Cl.[5] ..... E06B 9/06

[52] U.S. Cl. ..... 160/84.1 B; 160/84.1 F; 160/134

[58] Field of Search ..... 160/84.1 R, 84.1 A, 160/84.1 B, 84.1 C, 84.1 D, 84.1 E, 84.1 F, 84.1 G, 330, 134, 348

[56] References Cited

U.S. PATENT DOCUMENTS

| | | |
|---|---|---|
| 451,068 | 4/1891 | Park . |
| 4,450,027 | 5/1984 | Colson . |
| 4,753,281 | 6/1988 | Wagner . |
| 4,846,243 | 7/1989 | Schneider . |
| 4,858,669 | 8/1989 | Vinson . |
| 4,861,404 | 8/1989 | Neff . |
| 4,934,436 | 6/1990 | Schnebly . |
| 5,002,112 | 3/1991 | Schnebly et al. . |
| 5,015,317 | 5/1991 | Corey et al. . |
| 5,139,070 | 8/1992 | Kidd . |
| 5,207,257 | 5/1993 | Rupel et al. ..... 160/84.1 F |

*Primary Examiner*—Blair M. Johnson
*Attorney, Agent, or Firm*—Vernon J. Pillote

[57] ABSTRACT

An adjustable shade comprising a pleated expandable and collapsible main shade and a pleated expandable and collapsible auxiliary shade on a lower end of the main shade, with the auxiliary shade arranged so that the pleats can fan outwardly from one side edge of the auxiliary shade. Expansion of the one side edge of the auxiliary shade is controlled so that it can form an inverted fan configuration with the one side edge of the shade adjacent the center of the fan configuration. The auxiliary shade is preferably formed in two auxiliary shade sections with each arranged so that it can be moved from a collapsed condition paralleling the pleats in the main shade to an expanded condition with the pleats radiating outwardly from one side edge through the arc of about 90 degrees. The auxiliary shade sections are preferably mounted on a lower rail attached to the lower end of the main shade. The auxiliary shade sections are normally gravitationally urged toward the inverted fan configuration and mechanism is provided for releasably retaining the auxiliary shade sections in a collapsed or folded condition.

21 Claims, 4 Drawing Sheets

FIG. 4
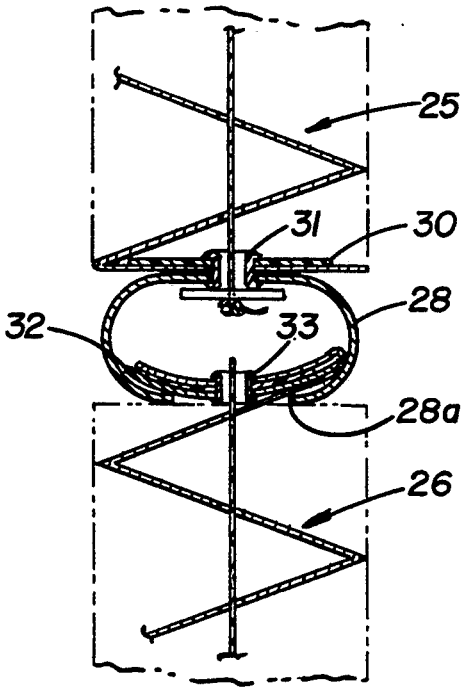
FIG. 5
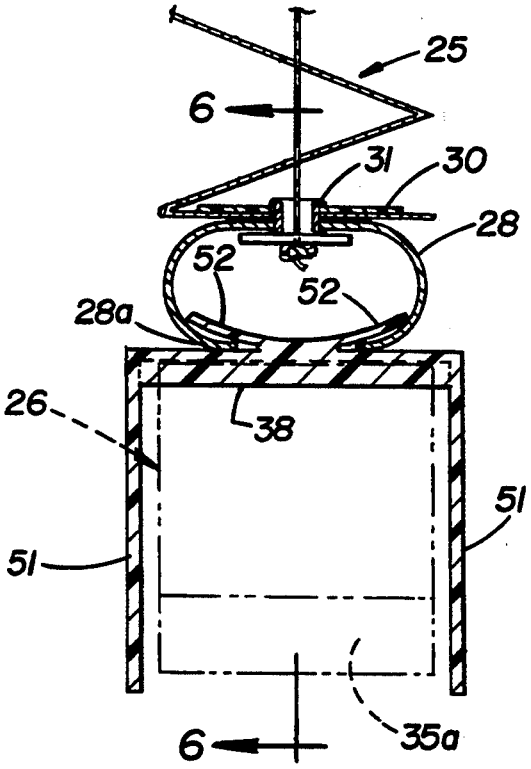
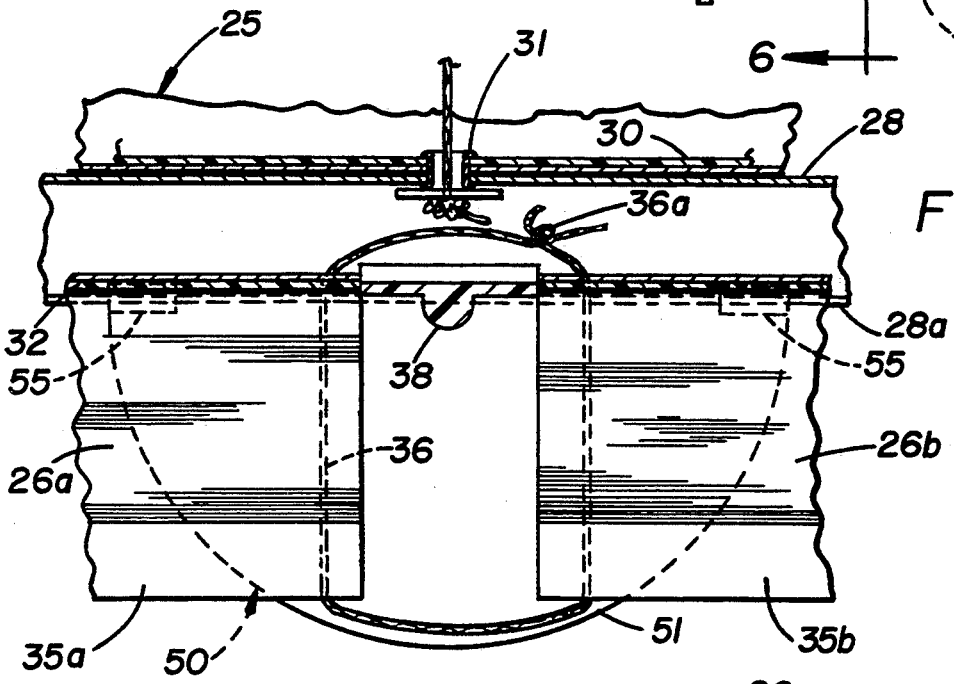
FIG. 6
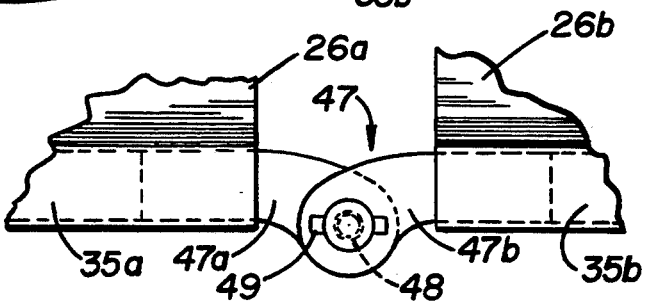
FIG. 7

FIG. 12
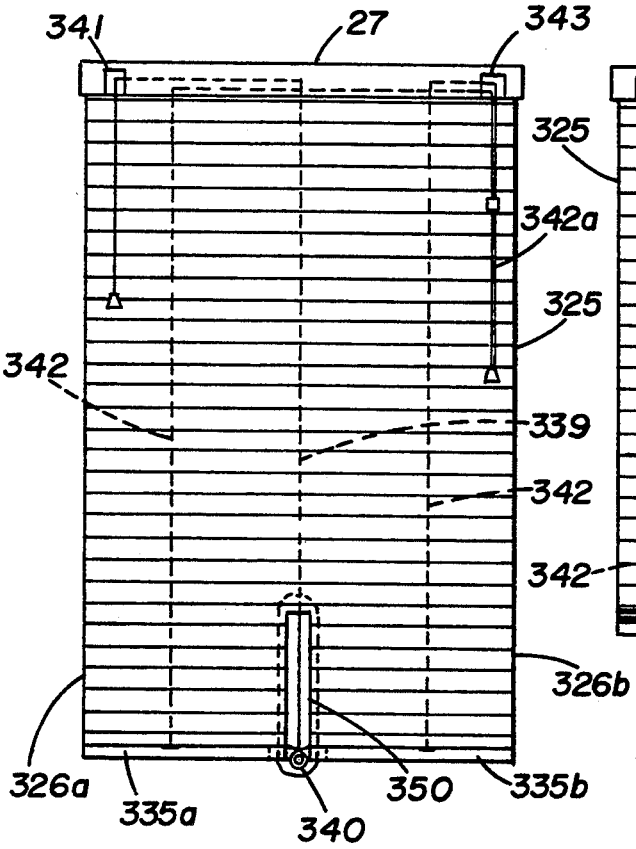
FIG. 11
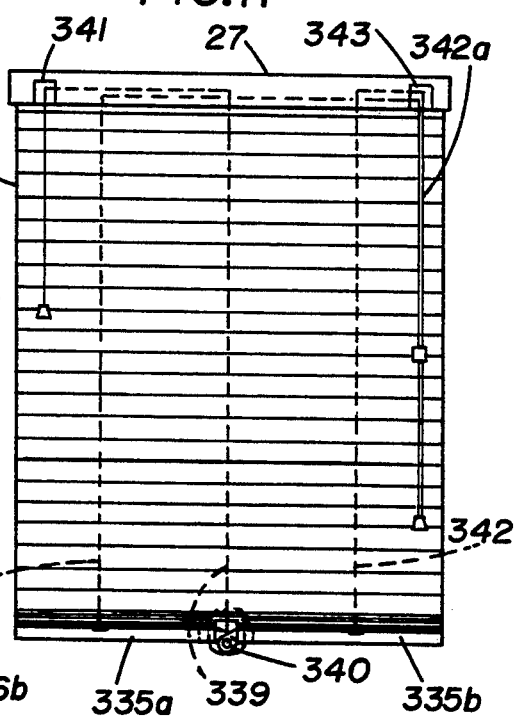
FIG. 13
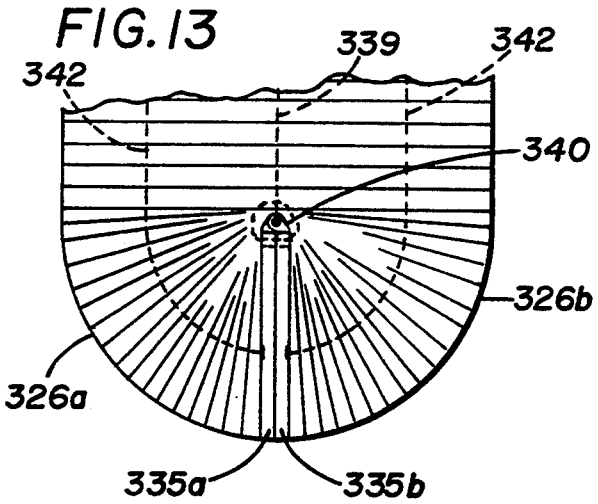
FIG. 16
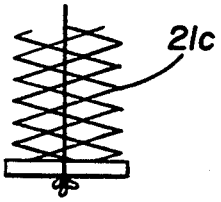
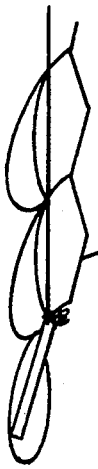
FIG. 17

ADJUSTABLE EXPANDABLE AND COLLAPSIBLE SHADE

CROSS-REFERENCE TO RELATED APPLICATIONS

This application is a continuation-in-part of the copending U.S. application of John D. Rupel and Judy M. Bergeman, Ser. No. 07/951,151, U.S. Pat. No. 5,207,257, filed Sep. 25, 1992.

BACKGROUND OF THE INVENTION

The present invention relates to adjustable expandable and collapsible window shades of the type having a head rail and a lower rail and lift cords for raising and lowering the lower rail. The pleated expandable and collapsible shade material is arranged to collapse along predetermined fold or creased lines into a compact stack to uncover the window opening when the lower rail is raised and to expand as the lower rail is lowered to wholly or partially cover the window opening. In the prior adjustable window shades of this type, the lower rail and lift cords for raising and lowering the lower rail operated in a manner to maintain the lower rail generally horizontal during movement between raised and lowered positions.

SUMMARY OF THE INVENTION

The present invention relates to improvements in adjustable shades formed of transversely pleated expandable and collapsible shade material and particularly to improvements in adjustable shades disclosed in the aforementioned U.S. application Ser. No. 07/951,151, the disclosure of which is incorporated herein by reference. In this prior application, arranged so that it can be formed into a decorative inverted fan configuration adapted to be raised and lowered with the shade. This adjustable shade was formed from a generally rectangular piece of transversely pleated expandable and collapsible shade material supported at its upper end on a head-rail with two lower rail sections attached to the lower end of the shade for relative movement between one position in which the lower rail sections extended in opposite directions generally parallel to the pleats in the shade material and a second position in which the lower rail sections extended downwardly in sidewise adjacent relation to draw the lower portion of the shade into an inverted fan configuration. In this adjustable shade, one cord operating mechanism was provided for raising the proximate ends of the lower rail sections while allowing the distal ends of the lower rail sections to swing downwardly and draw lower portions of the shade member into an inverted fan configuration, and a second cord operating mechanism was provided for raising and lowering the lower rail sections in unison and in parallel relation to the upper head rail.

This prior adjustable shade worked well with transversely pleated expandable and collapsible shades formed from a relatively soft material. However, it was found that some expandable and collapsible shade materials, because of the stiffness of the shade material and/or the cell configuration of the shade material, resisted bending when in a compact stack about an axis transverse to the stack and would not readily form an inverted fan configuration.

It is an object of the present invention to provide an adjustable shade formed of transversely pleated expandable and collapsible shade material in which a lower portion of the shade can be formed into an inverted fan configuration, even with relatively stiff expandable and collapsible shade materials.

Accordingly, the present invention provides an adjustable shade comprising a pleated expandable and collapsible main shade and a pleated expandable and collapsible auxiliary shade on a lower end of the main shade, with the auxiliary shade arranged so that the pleats can fan outwardly from one side edge of the auxiliary shade. Expansion of the one side edge of the auxiliary shade is controlled so that it can form an inverted fan configuration with the one side edge of the shade adjacent the center of the fan configuration. The auxiliary shade is preferably formed in two auxiliary shade sections with each arranged so that it can be moved from a collapsed condition paralleling the pleats in the main shade to an expanded condition with the pleats radiating outwardly from one side edge through an arc of about 90 degrees. The auxiliary shade sections are preferably mounted on a lower rail attached to the lower end of the main shade. The auxiliary shade sections are normally gravitationally urged toward the inverted fan configuration and means are provided for releasably retaining the auxiliary shade sections in a collapsed or folded condition.

BRIEF DESCRIPTION OF THE DRAWINGS

FIG. 4 is a fragmentary transverse sectional view taken on the plane 4—4 of FIG. 1 and illustrating parts on a larger scale;

FIG. 5 is a fragmentary transverse sectional view taken on the plane 5—5 of FIG. 1 and illustrating parts on a larger scale;

FIG. 6 is a fragmentary sectional view taken on the plane 6—6 of FIG. 5;

FIG. 7 is a fragmentary side view of a modified hinge arrangement for connecting the lower slats;

FIG. 11 is a schematic front view of a fourth embodiment of the adjustable shade;

FIG. 12 is a fragmentary schematic view of the shade of FIG. 11 at an intermediate stage of assembly;

FIG. 13 is a schematic front view illustrating the shade of FIG. 11 with the auxiliary shade in an inverted fan configuration;

FIG. 16 is a schematic partial end view illustrating the invention applied to a multi-cellular type expandable and collapsible shade; and FIG. 17 is a schematic partial end view illustrating the invention applied to a pocket type expandable and collapsible shade.

DETAILED DESCRIPTION

Figure 14:
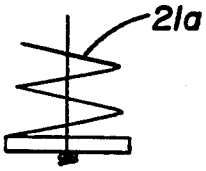
FIG. 14 is a schematic partial end view illustrating the invention applied to an accordion folded type expandable and collapsible shade.
Figure 15:
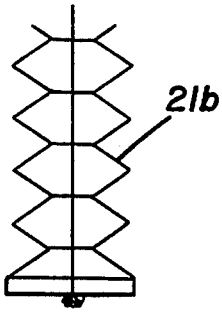
FIG. 15 is a schematic partial end view illustrating the invention applied to a honeycomb type expandable and collapsible shade.

As used herein, a pleated expandable and collapsible shade includes a shade or curtain which is pleated or folded transversely of its length so that it can be expanded to cover a window opening and collapsed into a compact stack. The pleated expandable and collapsible shade member may, for example, comprise a single web member accordion folded crosswise of its length such as illustrated in U.S. Pat. No. 4,753,281 and schematically illustrated at 21*a* in FIG. 14; honeycomb type shade material having cells extending transverse to the width of the shade member such as shown in U.S. Pat. Nos. 4,450,027 and 4,861,404 and schematically illustrated at 21*b* in FIG. 15; multi-cell type shade material such as disclosed in U.S. Pat. No. 5,015,317 and schematically illustrated at 21*c* in FIG. 16; and shade material formed with interconnected transverse pockets such as disclosed in U.S. Pat. No. 4,846,243 and schematically illustrated at 21*d* in FIG. 17.

Figure 1:
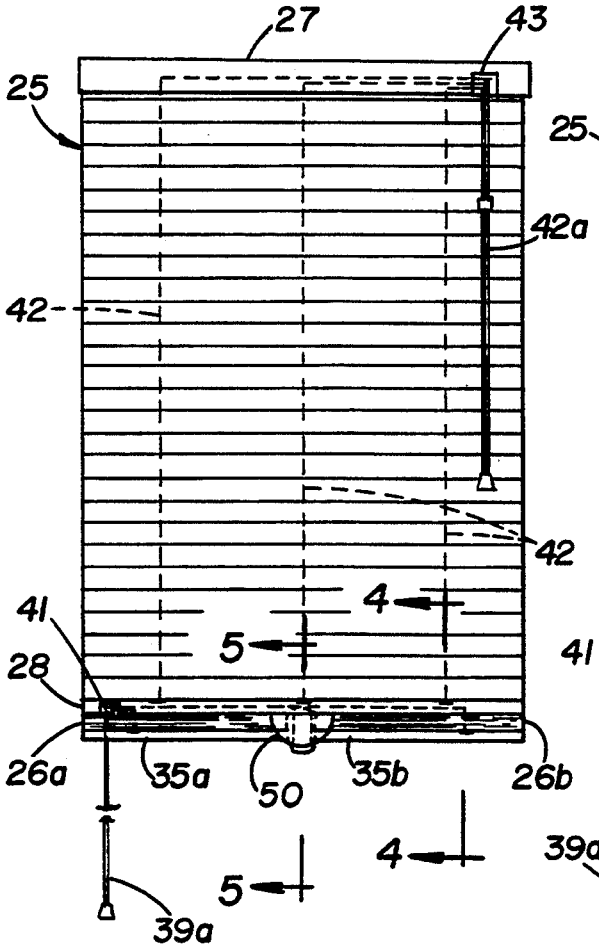
FIG. 1 is a schematic front view of an adjustable shade embodying the present invention and showing the auxiliary shade in a folded position.
Figure 2:
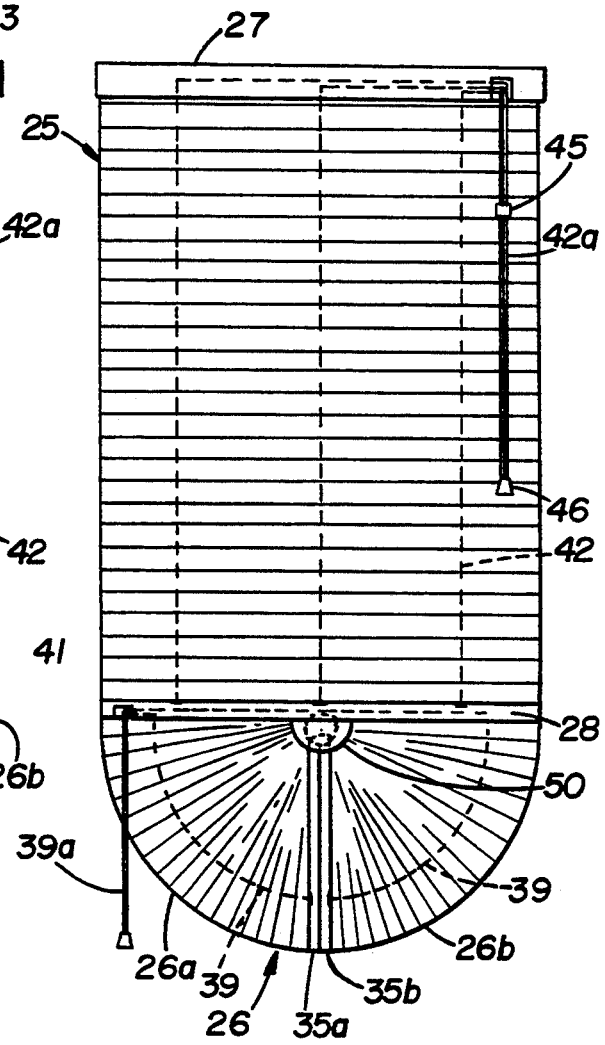
FIG. 2 is a schematic front view illustrating the shade of FIG. 1, with the auxiliary shade in an inverted fan configuration.
Figure 3:
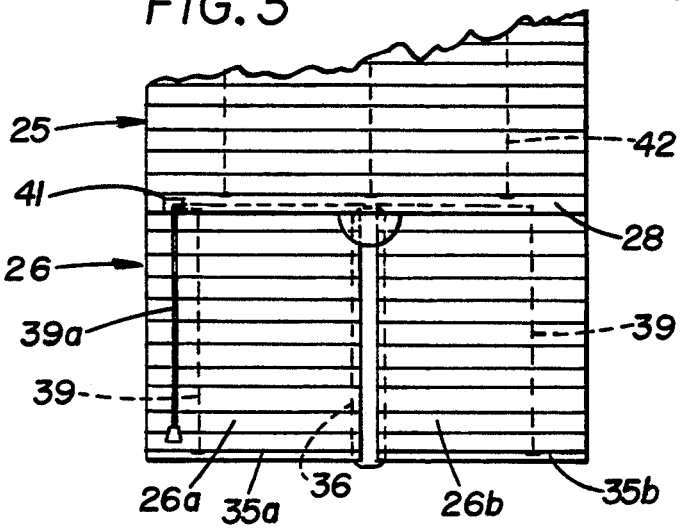
FIG. 3 is a fragmentary schematic partial front view of the shade of FIG. 1 at an intermediate stage of assembly.

The adjustable shade of the present invention comprises a pleated expandable and collapsible main shade 25 and a pleated and expandable and contractable auxiliary shade 26 arranged to form an inverted fan configuration on the lower end of the main shade. In the preferred embodiment illustrated in FIGS. 1–6, an upper end of the main shade 25 is attached to a head-rail 27 in a manner to be supported thereby with the folded pleats extending generally parallel to the head-rail, and the lower portion of the main shade is attached to a lower rail 28, with the lower rail extending generally parallel to the folds or creases in the main shade member. The lower rail is rigid and has a length correlative with the width of the main shade and, as best shown in FIGS. 4–6, the lower rail 28 defines a downwardly opening channel with opposed flanges 28*a* along the lower side of the channel. The lower end of the main shade is reinforced by a stiffening strip 30 and attached to the upper side of the lower rail 28 as by adhesive and grommets 31. The pleated expandable and contractable auxiliary shade is preferably formed in two sections 26*a*, 26*b* and the upper end of each section has a stiffening strip 32 attached thereto as by adhesive and grommets 33 as best shown in FIG. 4. The stiffening strip 32 has a width greater than the spacing between the flanges 28*a* on the lower rail and the upper ends of the auxiliary shade sections are slidable into the lower rail for support thereon with the upper ends of the first and second auxiliary shade sections in endwise aligned relation. The auxiliary shade sections 26*a* and 26*b* have a length measured in a direction transverse to the pleats such that, when the inner side edges are in a collapsed condition as shown in FIG. 1, the outer side edges can extend through at least 90 degrees as shown in FIG. 2. A rigid slat or rail section 35*a*, 35*b* is attached to the lower ends of each of the auxiliary shades 26*a*, 26*b* as by adhesive, grommets or the like. Means are provided for limiting expansion of the adjacent or inner side edges of embodiment illustrated, the auxiliary shade sections 26*a*, 26*b* and slats 35*a*, 35*b* have a row of openings formed therein adjacent the inner side edges of the shades, and a draw cord 36 is threaded through the openings in the shades and slats and over a support member 38 (FIG. 6) on the lower rail 28. The draw cord 36 is formed into a loop and the loop tightened and tied in a knot 36*a* (FIG. 6) during assembly to draw the adjacent ends of the slats 35*a* toward the lower rail until the auxiliary shade sections are in a substantially collapsed condition at their inner side edges as shown in FIG. 1. Excess portions of the cord loop 36 are cut off after assembly.

The auxiliary shades will be normally biased by gravity to an inverted fan configuration as shown in FIG. 2 and means are provided for releasably retaining the auxiliary shade sections in a collapsed condition as shown in FIG. 1. In the preferred embodiment illustrated, the auxiliary shade sections have a second row of openings therethrough at a location inwardly from the distal ends thereof and auxiliary shade operating cords 39 are attached to the slats 35*a*, 35*b* and extend through openings in the auxiliary shade sections to the lower rail 28. The auxiliary shade operating cords extend lengthwise through the lower rail and through a cord lock device 41 on the lower rail and terminate in depending operating portions 39*a*. The operating portions 39*a* of the cords are preferably arranged for movement in unison, to simultaneously raise the distal ends of the slats 35*a*, 35*b* to the collapsed condition as shown in FIG. 1. A set of main shade operating cords are provided for raising and controlling lowering of the lower rail 28. As best shown in FIGS. 1 and 2, a plurality of lift cords 42 are attached at their lower ends to the lower rail 28 and extend upwardly through rows of openings in the main shade 25 and over guides in the head-rail and through a cord lock 43 and terminate in downwardly extending operating portions 42*a*. The depending operating portions are interconnected by a cord equalizer 45 and terminate in a cord pull 46.

A shield member 50 is advantageously attached to the lower rail section to conceal the cord loop 36 and the light opening that is formed between the adjacent side edges of the auxiliary shade sections. As shown in FIGS. 5 and 6, the shield comprises spaced semi-circular side pieces 51, that are interconnected by the support member 38. The support member 38 underlies the lower rail 28 and ears 52 are formed integrally with the cross member and shaped to extend into the lower rail and overlie the flanges on the lower rail to support the shield on the lower rail. The side pieces 51 are spaced apart a distance sufficient to receive the auxiliary shades in a collapsed condition and inwardly extending ears 55 (FIG. 6) are formed on the side pieces and underlie the lower rail to stabilize the shield on the lower rail.

With the above arrangement it will be seen that the auxiliary shade can be raised and lowered with the main shade when the auxiliary shade sections are either in a collapsed condition as shown in FIG. 1 or in an inverted fan configuration as shown in FIG. 2. Further, since the auxiliary shade sections are arranged so that the pleats can fan outwardly from one side edge of the auxiliary shade sections, the stiffness of the shade material does not adversely affect movement of the auxiliary shade between a collapsed condition as shown in FIG. 1 and the inverted fan configuration as shown in FIG. 2. Since the auxiliary shade sections are relatively freely movable to the inverted fan configuration, gravity is sufficient to move the auxiliary shade sections to the inverted fan configuration when the operating cords 39 are manipulated to release the cord lock 41. If desired, a means such as magnets may be provided on the slats 35, to releasably hold the slats 35*a*, 35*b* together as shown in FIG. 2.

The auxiliary lift cords 42 and cord lock 41 function to releasably hold the slats in a raised position. In lieu of the auxiliary lift cords 42 and cord lock, it is also contemplated that the slats or rail sections 35*a*, 35*b* can be hingedly interconnected as shown in FIG. 7 by a hinge device 47 having means to releasably hold or retard movement of the slats out of the raised position. The hinge device may, for example, comprise a hinge in which leaves 47*a*, 47*b* are pivotally connected by a hinge pin 48 and at least one of the leaves has detents or protrusions 49*a* that are arranged to engage corresponding depressions (not shown) in the mating face of the sidewise adjacent hinge leave when the slats 35*a*, 35*b* are in a raised or aligned position. As will be apparent, other means such as a releasable latch or magnets can also be used to releasable hold the slats in a raised position.

Figure 8:
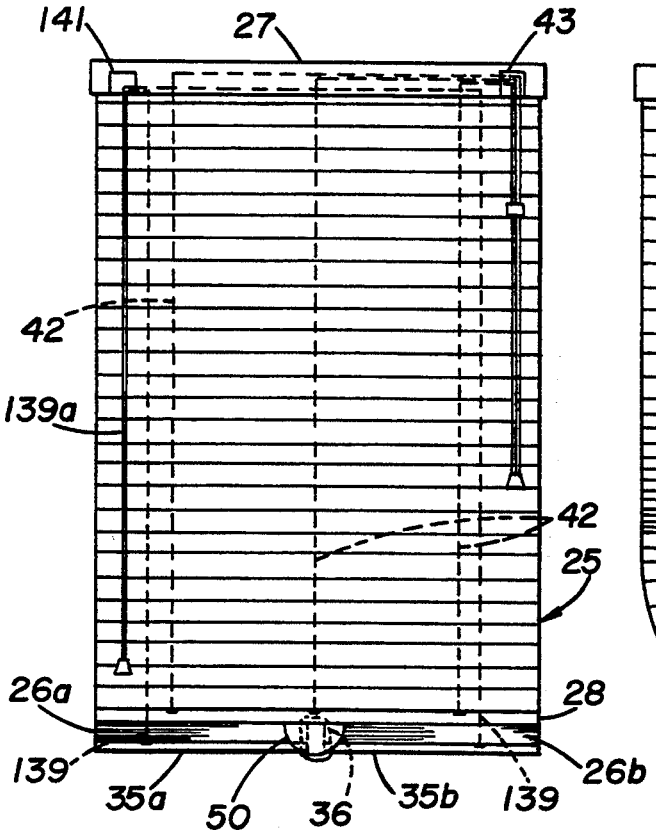
FIG. 8 is a schematic front view illustrating a second embodiment of the adjustable shade showing the auxiliary shade section in a folded position.
Figure 9:
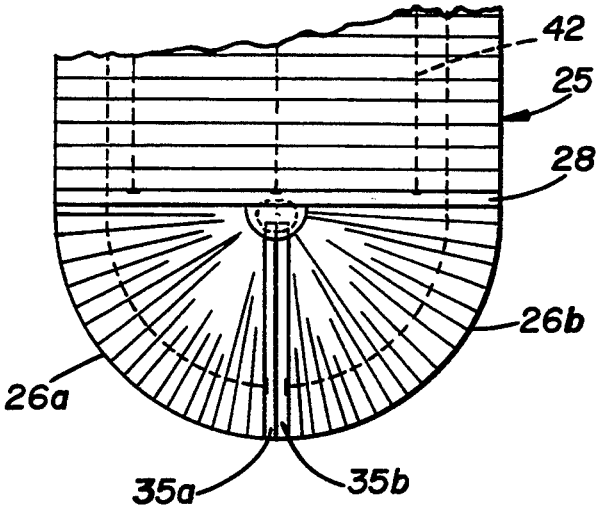
FIG. 9 is a schematic partial front view illustrating the shade of FIG. 8, with the auxiliary shade in an inverted fan configuration.

The embodiment of FIGS. 8 and 9 is generally the same as the embodiment of FIGS. 1–6 with a modified operating cord arrangement for the auxiliary shades. Like numbers are used to designate the same parts as in FIG. 1 and like numerals in the 100 series are used to designate modified parts. In this embodiment, operating cords 139 for the auxiliary shade sections extend through openings in the auxiliary shade and through the lower rail 28 and through rows of openings in the main shade over guides in the head-rail 43. The cords 139 extend lengthwise of the head-rail and through a cord lock 141 in the head-rail and terminate in operating portions 139*a*.

Figure 10:
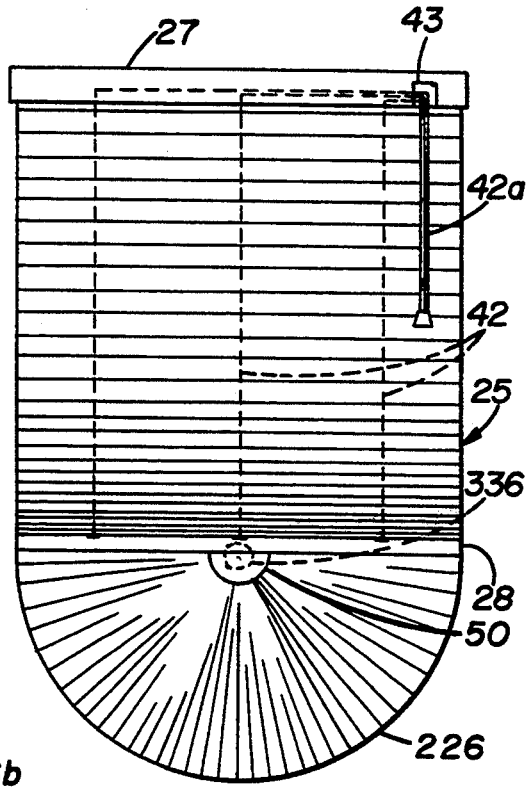
FIG. 10 is a schematic front view illustrating a third embodiment of the adjustable shade.

The embodiment of FIG. 10 is generally the same as FIG. 1 except that the auxiliary shade 26 is formed in one piece. Like numerals are used to designate the parts in FIG. 10 that are the same as in FIG. 1–3, and like numerals in the 200 series are used to designate modified parts. In this embodiment, the auxiliary shade is formed in one piece designated 226 of pleated expandable and contractable material. The auxiliary shade 226 has a width measured parallel to the pleats that is slightly less than one-half the width of the main shade and the auxiliary shade has a length such that the outer edge when fully expanded can extend through an arc of at least 180 degrees as shown in FIG. 10. Stiffening slats such as 32 described in connection with FIG. 1 are provided on the ends of the shade 226 and a cord loop 336 is threaded through a row of openings in the shade adjacent one side edge. The auxiliary shade 226 can be assembled on the lower rail by sliding one end portion of the auxiliary shade into the lower rail followed by inserting the shield member and thereafter forming the auxiliary shade into a fan configuration and sliding the other end portion of the auxiliary shade into the lower rail. As in FIG. 1, a draw cord 236 is entrained over a support member on the shield 50 and, when tightened, draws the inner side edge of the auxiliary shade into an eye to control expansion of the inner side edge of the auxiliary shade. The outer side edge is expandable to form a downwardly extending fan configuration.

The embodiment of FIGS. 11–13 is generally the same as the embodiment of FIG. 1 except that the auxiliary shade sections are formed integrally with the lower end of the main shade and the lower rail 28 is omitted. Like numerals are used to designate the same parts and like numerals in the 300 series are used to modified parts. In this embodiment, one piece of pleated expandable and contractable shade material is slotted upwardly from its lower end as shown at 350 in FIG. 12 to form a main shade 325 and auxiliary shade sections 326*a* and 326*b* integrally joined to the lower end of the main shade. The upper end of the main shade 325 is attached to the head-rail 27 and stiffening slats or rail sections 335*a*, 335*b* are provided on the lower ends of the auxiliary shade sections. Adjacent ends of the slats 335*a* and 335*b* are flexibly interconnected by a hinge device 340 for movement between a position in which they extend in relatively opposite directions as shown in FIG. 11 and a position in which they extend downwardly from the connector 140 as shown in FIG. 13. Auxiliary shade sections 326*a* and 326*b* are formed with a row of openings inwardly of the adjacent side edges of the auxiliary shade sections and a draw cord 336 is connected to the hinge device 340 and extends through the row of openings. The draw cord is tightened during assembly to draw the adjacent side edges of the auxiliary shade sections 326*a*, 326*b* toward the slats 335*a*, 335*b* into a loosely collapsed condition which will allow the auxiliary shade sections to fan outwardly from the inner side edges thereof to form an inverted fan configuration as shown in FIG. 13. One set of main shade operating cords 342 are attached to the slats 335*a*, 335*b* and extend upwardly through rows of openings in the main shade 325 and over guides in the head-rail 27 and through a cord lock 343 and terminate in downwardly extending operating portions 342*a*, for raising and lowering the main shade and the auxiliary shade sections in a generally rectangular configuration. An auxiliary shade operating cord 339 is attached to the hinge device 340 adjacent inner ends of the slats and extends upwardly through a row of openings in the main shade and over guides in the head-rail and through an auxiliary cord lock 341 in the head-rail and terminate in downwardly extending operating portions 339*a*. The auxiliary shade operating cord can be pulled to move the auxiliary shade sections into the inverted fan configuration shown in FIG. 13 and, when pulled further, will raise the main shade with the auxiliary shade sections in an inverted fan configuration . The main shade operating cords 392 can be used to raise the auxiliary shade sections with the main shade, while the auxiliary shade sections are in the collapsed condition as shown in FIG. 11.

The notch 350 in the shade can extend to a height corresponding to the radius of the arc to be formed by the auxiliary shade section in an inverted fan configuration. However, the depth of the notch can be made somewhat less than the full radius of the arc to be formed, and the auxiliary shade sections will readily expand to form the lower portion of the inverted fan configuration and the lower portion of the main shade will expand to form the upper portion of the fan configuration.

If desired, the hinge device 340 could be of a type shown and described at 47 in FIG. 7 having means to releasably hold or retard movement of the slats out of a raised or aligned position. With such a hinge device, the slats 335*a* and 335*b* could be manually moved into and out of a raised condition as shown in FIG. 11 and releasably retained in the raised condition by the hinge device and the auxiliary shade operating cord 342 could be omitted.

In the embodiments illustrated, a single auxiliary shade is provided at the lower end of the main shade. It is deemed apparent that, for wide window openings, two or more auxiliary shades can be provided along the lower end of a single main shade.

The embodiments of the invention in which an exclusive property or privilege is claimed are defined as follows:

1. An adjustable shade comprising: a pleated expandable and collapsible main shade having upper and lower ends generally paralleling pleats in the main shade and side edges transverse to the pleats in the main shade, an elongated upper head rail and an elongated lower rail respectively attached to upper and lower ends of the main shade and extending generally parallel to pleats in the main shade, a pleated expandable and collapsible auxiliary shade having first and second ends generally paralleling pleats in the auxiliary shade and first and second side edges transverse to pleats in the auxiliary shade, means mounting first and second ends of the auxiliary shade on the lower rail with the first and second ends of the auxiliary shade in endwise aligned relation, means limiting expansion of the first side edge of the auxiliary shade such that the auxiliary shade extends downwardly in inverted fan configuration from the lower rail with the first side edge of the auxiliary shade at the center of the fan configuration, and lift cords attached to said lower rail and extending upwardly to said upper headrail for raising and lowering the lower rail, the auxiliary shade being raised and lowered with the lower rail.

2. An adjustable shade according to claim 1 wherein the lower rail has a lengthwise extending downwardly opening channel with opposed flanges, a stiffening member on first and second ends of the auxiliary shade and slidable in said channel for supporting said ends of the auxiliary shade on the lower rail.

3. An adjustable shade according to claim 1 wherein the auxiliary shade has one row of openings therethrough, adjacent said first side edge, said means for limiting expansion comprising cord means extending through said one row of openings for limiting expansion of the auxiliary shade at said first side edge thereof while permitting expansion of the auxiliary shade at the second side edge thereof.

4. An adjustable shade according to claim 2 wherein said means for limiting expansion of the auxiliary shade includes a row of openings through the auxiliary shade adjacent said first side edge thereof, and cord means extending through said row of openings.

5. An adjustable shade comprising: a pleated expandable and collapsible main shade having upper and lower ends generally paralling pleats in the main shade and side edges transverse to the pleats in the main shade, an elongated upper head rail and an elongated lower rail respectively attached to upper and lower ends of the main shade and extending generally parallel to pleats in the main shade, a pleated expandable and collapsible auxiliary shade comprising first and second auxiliary shade sections each having first and second ends generally paralleling pleats in the auxiliary shade and side edges transverse to pleats in the auxiliary shade, means mounting the first ends of the auxiliary shade sections on the lower rail with first side edges of the auxiliary shade sections in adjacent relation, lift cords attached to said lower rail and extending upwardly to said upper head-rail for raising and lowering the lower rail, the auxiliary shade being raised and lowered with the lower rail, means for limiting expansion and contraction of the first and second auxiliary shade sections at the adjacent first side edges of the auxiliary shade sections while permitting expansion and contraction of the first and second auxiliary shade sections along outer second side edges of the auxiliary shade sections, the second ends of the first and second shade sections being movable between a first position generally paralleling the lower rail and a second position extending downwardly in sidewise adjacent relation from the lower rail to form an inverted fan configuration.

6. An adjustable shade according to claim 5 wherein the first and second auxiliary shade sections have respective first and second rows of openings therethrough spaced a selected distance from the second side edge of the auxiliary shade section and first and second auxiliary shade operating cord means connected to the second end of the auxiliary shade sections and respectively extending through the first and second rows of openings in the auxiliary shade sections for controlling expansion and contraction of the auxiliary shade sections along the second edges of the auxiliary shade sections.

7. An adjustable shade according to claim 6 including auxiliary cord lock means on the lower rail for engaging the first and second auxiliary shade operating cords.

8. An adjustable shade according to claim 6 including auxiliary cord lock means on the head rail for engaging the first and second auxiliary shade operating cords.

9. An adjustable shade according to claim 5 including means for selectively holding the second ends of the first and second auxiliary shade sections in the first position.

10. An adjustable shade according to claim 5 including slats attached to the second ends of the first and second auxiliary shade sections, and hinge means interconnecting the slats, the hinge means including means for releasably retaining the slats in an endwise aligned position.

11. An adjustable shade comprising, a pleated expandable and collapsible main shade having upper and lower ends generally paralleling pleats in the main shade and side edges transverse to pleats in the main shade, an elongated upper head rail attached to the upper end of the main shade, an elongated lower rail attached to the lower end of the main shade, pleated expandable and collapsible first and second auxiliary shade sections each having upper and lower ends generally paralleling pleats in the respective first and second auxiliary shade sections and first and second side edges extending transverse to pleats in the respective first and second auxiliary shade sections, means mounting the first and second auxiliary shade sections on the lower rail with the upper ends of the first and second auxiliary shade sections in endwise aligned relation, means for limiting expansion of the first and second auxiliary shade sections along the first side edges thereof while permitting expansion of the first and second auxiliary shade sections along the second side edges thereof into an inverted fan configuration, and lift cords attached to the lower rail and extending upwardly to the upper head rail for raising and lowering the lower rail.

12. An adjustable shade according to claim 11 wherein the first and second auxiliary shade sections have respective first and second rows of openings therethrough spaced a selected distance from the second side edge of the auxiliary shade section, and first and second auxiliary shade operating cord means connected to the lower ends of the first and second auxiliary shade sections and respectively extending through the first and second rows of openings in the auxiliary shade sections for adjustably controlling expansion and contraction of the auxiliary shade sections along the second edge of the auxiliary shade.

13. An adjustable shade according to claim 12 including auxiliary cord lock means on the lower rail for engaging the first and second auxiliary shade operating cords.

14. An adjustable shade according to claim 12 including auxiliary cord lock means on the head rail for engaging the first and second auxiliary shade operating cords.

15. An adjustable shade according to claim 11 including first and second slat means on the lower ends of the first and second auxiliary shade sections for stiffening the latter.

16. An adjustable shade according to claim 11 including a slat attached to the lower ends of each of the first and second auxiliary shade sections, hinge means interconnecting the slats for releasably retaining the slats in a position paralleling the lower rail.

17. An adjustable shade comprising, a pleated expandable and collapsible main shade having upper and lower ends generally paralleling pleats in the main shade and side edges transverse to pleats in the main shade, an elongated upper head rail attached to the upper end of the main shade, pleated expandable and collapsible first and second auxiliary shades each having upper and lower ends generally paralleling pleats in the respective first and second auxiliary shades and first and second side edges extending transverse to the pleats of the respective first and second auxiliary shades, the upper ends of the first and second auxiliary shades being integral with the lower end of the main shade and the first side edges of the first and second auxiliary shades being adjacent each other, means for limiting expansion and contraction of the first and second auxiliary shades along the first side edges thereof while permitting expansion of the first and second auxiliary shade sections along the second side edges thereof into an inverted fan configuration, and lift cords for raising and lowering the main shade.

18. An adjustable shade according to claim 17 including first and second slat means on the lower ends of the first and second auxiliary shades for stiffening the latter.

19. An adjustable shade according to claim 18 including hinge means interconnecting the first and second slat means.

20. An adjustable shade according to claim 19 including auxiliary shade operating cord means connected to said hinge means.

21. An adjustable shade according to claim 19 wherein the hinge means includes means for releasably retaining the slats in an endwise aligned position.

* * * * *